US005456005A

United States Patent [19]

Satoh et al.

[11] Patent Number: 5,456,005

[45] Date of Patent: Oct. 10, 1995

[54] METHOD AND APPARATUS FOR SECURING A CRIMP-STYLE TERMINAL TO A CABLE

[75] Inventors: Kazuhiro Satoh; Hideo Kikuchi, both of Tochigi, Japan

[73] Assignee: Sumitomo Electric Industries, Ltd., Osaka, Japan

[21] Appl. No.: 114,056

[22] Filed: Aug. 31, 1993

[30] Foreign Application Priority Data

Sep. 1, 1992 [JP] Japan ..... 4-233236

[51] Int. Cl.[6] ..... H01R 43/04

[52] U.S. Cl. ..... 29/863; 29/749; 29/753

[58] Field of Search ..... 29/861, 863, 749, 29/753

[56] References Cited

U.S. PATENT DOCUMENTS

| | | | |
|---|---|---|---|
| 4,916,810 | 4/1990 | Yeomans | 29/863 |
| 4,979,291 | 12/1990 | Phillips et al. | 29/863 |
| 5,018,270 | 5/1991 | Caumanns | 29/863 |
| 5,123,165 | 6/1992 | Strong et al. | 29/861 |
| 5,197,186 | 3/1993 | Strong et al. | 29/863 |

*Primary Examiner*—Carl J. Arbes

*Attorney, Agent, or Firm*—Cushman Darby & Cushman

[57] ABSTRACT

The present invention provides a method and apparatus for securely crimping a crimp-style terminal to a small diameter conductor of a cable. A dummy conductor is prepared and a crimping portion of the terminal is crimped about both the dummy conductor and the conductor of the cable. The dummy conductor is a portion of second conductor of the cable, isolated from the conductor of the cable, or alternatively, a portion of a second conductor independent of the cable. A cutter cuts off the dummy conductor from the second conductor to electrically isolate the dummy conductor from the second conductor when the terminal is crimped about the dummy conductor and the conductor of the cable.

11 Claims, 4 Drawing Sheets

METHOD AND APPARATUS FOR SECURING A CRIMP-STYLE TERMINAL TO A CABLE

BACKGROUND OF THE INVENTION

1. Field of the Invention

This invention relates to a method for connecting a terminal to a multi-conductor cable typically comprising extremely thin conductors and commonly used with medical equipment and electronic instruments.

2. Description of the Related Art

Crimp-style terminals are commonly used to connect a cable to a connector. The crimp-style terminal first must be connected to the cable. Often, the size of the crimp-style terminal is selected based on the thickness of the wire, namely, the size of the conductor(s) and the thickness of the insulation. Once the selected terminal is crimped onto an end portion of the wire, the terminal then can be attached to the connector to electrically couple the cable to the connector.

Medical equipment and electronic instruments often employ cables having extremely thin central conductors with small cross-sectional areas on the order of, for example, 0.005 $mm^2$, so that the multi-conductor cables can be as thin as possible. However, many times, suitable sized crimp-style terminals cannot be found for such thin conductors. Therefore, a slightly larger crimp-style terminal must be used.

As shown in FIG. 3, the crimp height 17 of the crimped portion of a wire barrel 14 of a crimp terminal can be made extremely small to crimp the terminal to the thin central conductor 3 of the thin cable. However, such crimping technique often is not effective in securing the terminal to the central conductor 3. Thus, problems with contact resistance and tensile fracture often occur. In addition, the abnormal force applied to crimpers 7, 8 and anvils 10, 11 of a crimping machine (see, for example, FIG. 1A) to reduce the crimp height of the larger crimp-style terminal increases the incidence of damage to these and other crimping machine components due to wear and breakage.

To avoid these problems, a crimp-style terminal can be crimped to an end portion of a thick cable having thick conductors. Then, the thin conductors of a thin cable can be soldered to the other end of the thick conductors of the thick cable to electrically couple the thin cable to the crimp-style terminal. However, this method is time-consuming and cumbersome because many times, a plurality of conductors must be soldered to each other.

SUMMARY OF THE INVENTION

The present invention defines a method for connecting a crimp-style terminal to a cable comprising the step of crimping a crimp-style terminal to both a dummy conductor and the central conductor of the cable when the central conductor of the cable comprises extremely thin conductors. The present invention further defines a crimping apparatus comprising a crimping device for crimping a crimp-style terminal to a central conductor of a cable, and a device for cutting a dummy conductor at a predetermined location when the dummy conductor is used in cooperation with the central conductor of the cable to enable the terminal to be more securely crimped to the central conductor.

This method and apparatus eliminate forced crimping by allowing the terminal to be crimped to the conductor without making the crimp height extremely small. As a result, the terminal is more securely connected to the conductors of the cable, and therefore, problems associated with high contact resistance and tensile fracture strength can be reduced. In addition, since it is not necessary to apply abnormal force to the crimpers and the anvils of the crimping machine, components of the machine are less likely to wear and break.

Additional objects and advantages of the invention will be set forth in the description which follows, and in part will be obvious from the description, or may be learned by practice of the invention. The objects and advantages of the invention may be realized by means of the instrumentalities and combinations particularly pointed out in the appended claims.

BRIEF DESCRIPTION OF THE DRAWINGS

The accompanying drawings illustrate the presently preferred embodiments of the invention and, together with the general description above and the detailed description of the preferred embodiments provided below, explain the features of the invention, wherein.

DETAILED DESCRIPTION OF THE PREFERRED EMBODIMENTS

Figure 1A:
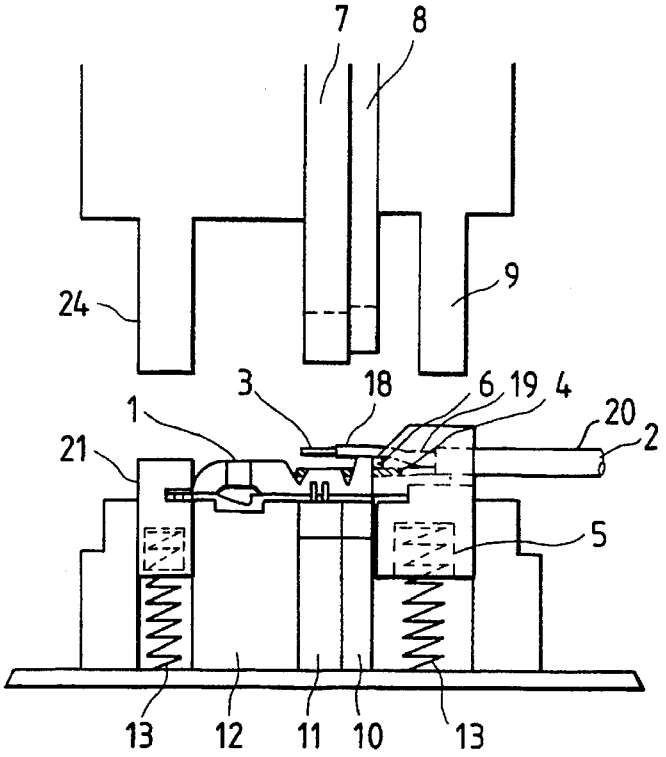
FIG. 1A is a schematic diagram showing a crimping apparatus of the first embodiment of the invention.

As shown in FIG. 1A, a coaxial cable 2 includes a central conductor 3 comprising 7 tin-plated copper alloy wires, each having a diameter of approximately 0.03 mm (AWG40). The central conductor 3 is insulated by an expanded PTFE tape 18 and the insulated conductor is spirally shielded by 35 tin-plated copper wires 19, each having a diameter of approximately 0.03 mm. An external sheath 20 is disposed about the 35 tin-plated copper wires to form the coaxial cable 2. The cross-sectional area of the central conductor 3 of the coaxial cable 2 is approximately 0.005 $mm^2$, whereas the cross-sectional area of the spirally shielding wires, when collectively twisted together, is approximately 0.025 $mm^2$.

The following is a crimping method using an apparatus as shown in FIG. 1A in which a portion of the spirally shielding wires 19 and the central conductor 3 are crimped together with a small standard crimp-style terminal 1 which is ideally used with wires having a cross-sectional area within the range of approximately 0.013 to 0.032 mm (AWG36 to AWG32).

Figure 4A:
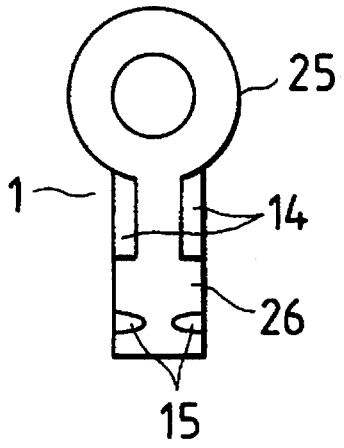
FIGS. 4A and 4B are top and side diagrammatic views, respectively, of a standard crimp-style terminal.
Figure 4B:
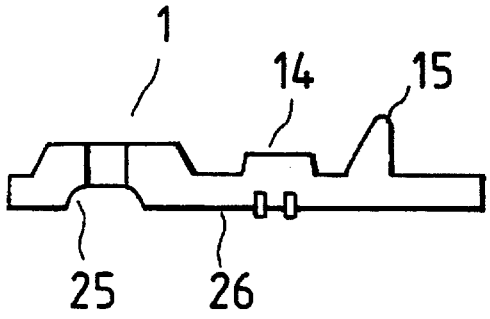

FIGS. 4A and 4B illustrate top and side views, respectively, of a standard crimp-style terminal 1 having a terminal portion 25, a conductor crimping potion 14, and an insulation crimping portion 15 connected to each other by a base portion 26. Typically, the terminal portion 25, conductor crimping portion 14, insulation crimping portion 15 and base portion 26 are integral with each other.

Figure 2A:
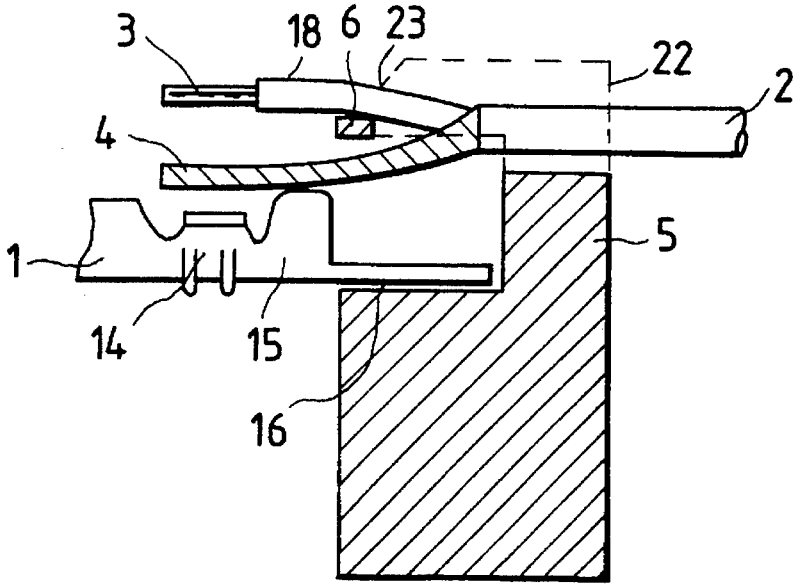
FIG. 2A is an enlarged view of the cutter block of the first embodiment.
Figure 5:
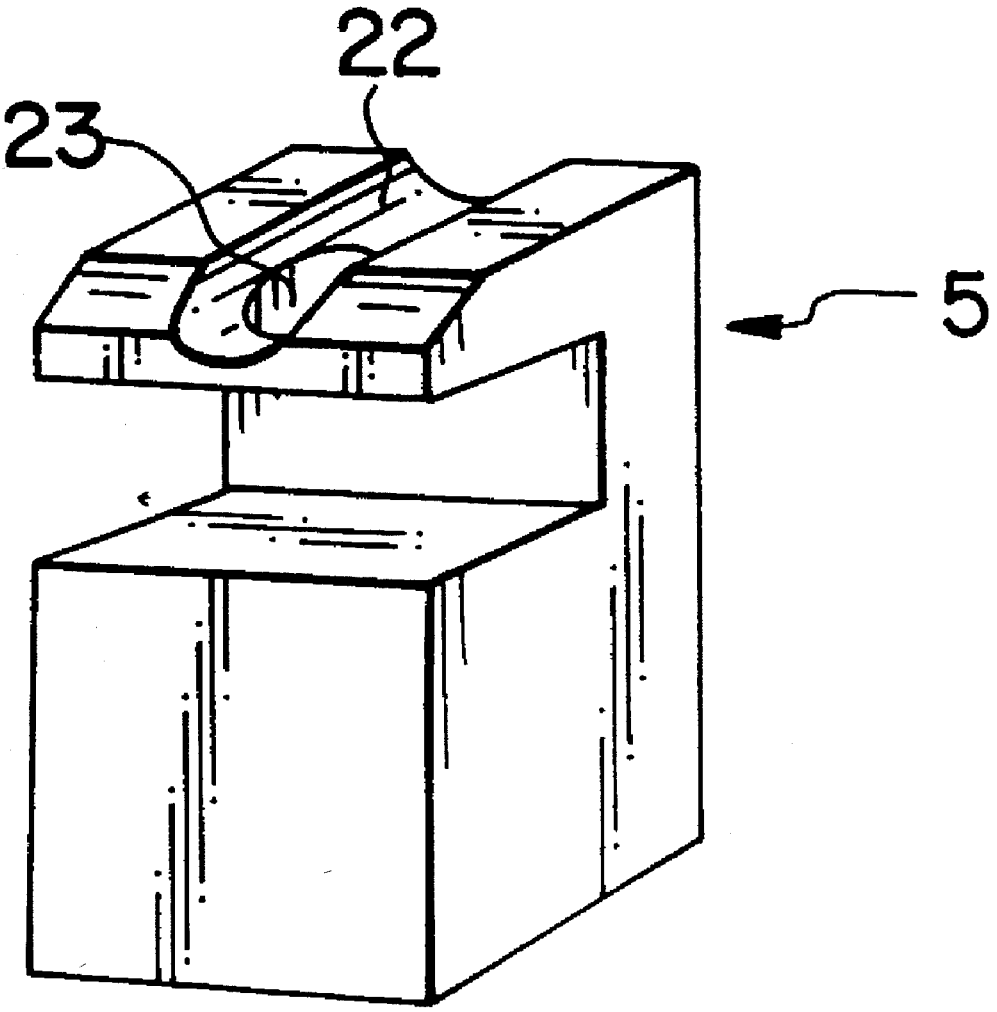
FIG. 5 is a perspective view of the cutter block of the first and second embodiments.

As shown in FIG. 1A, the terminal 1 is placed at a predetermined location on a base 12 of the crimping apparatus with its tip inserted in an opening in block 21. The insulation 19 is removed from a portion of the coaxial cable 2 and the spirally shielding wires 19 of the coaxial cable 2 are collectively twisted to form twisted wire 4. Then, the central conductor 3 and twisted wire 4 are inserted through a guide 22 (see FIG. 5) in the cutter block 5. As further shown in FIG. 2A, the twisted wire 4 is inserted through a hole 23 (see FIG. 5) and placed below a blade 6 of the cutter block 5, and the central conductor is guided through the guide 22 in the cutter block 5 above the blade 6.

To crimp the terminal 1 to the coaxial cable 2, a push block 9, an insulation crimper 8, a wire crimper 7, and a stabilizing block 24 are lowered simultaneously toward cutter block 5, insulation anvil 10, wire anvil 11, and block 21, respectively. Block 21 is supported by spring 13 which allows block 21 to move slightly in a vertical direction against the movement of the stabilizing block 24, if necessary, to maintain the terminal 1 substantially in parallel with the crimpers, blocks and anvils.

Accordingly, the insulation crimper 8 and insulation anvil 10 cooperate to crimp the insulation crimping portion 15 about the insulation 18 of the conductor 3, and the wire crimper 7 and wire anvil 11 cooperate to crimp the conductor crimping portion 14 about the conductor 3. At this time, the conductor crimping portion 14 is crimped about both the twisted wire 4 and the central conductor 3 so that the twisted wire 4 acts as the dummy conductor.

As the push block 9 is lowered, the push block 9 pushes the cutter block 5 downward against the force of spring 13. As a result, the blade 6 of the cutter block 5 forces the twisted wire 4 against an extended portion 16 of the base portion 27 of the terminal 1, and shears both the twisted wire 4 and the extended portion 16. Thus, the spirally shielding wires 19 remaining in the coaxial cable 2 are severed from the spirally shielding wires 19 making up the twisted wire 4.

Hence, this procedure allows an oversized crimp-style terminal to be crimped securely to a conductor having extremely thin wires. Also, although the spirally shielding wires are used as the dummy conductor, other types of dummy conductors can be used.

Figure 1B:
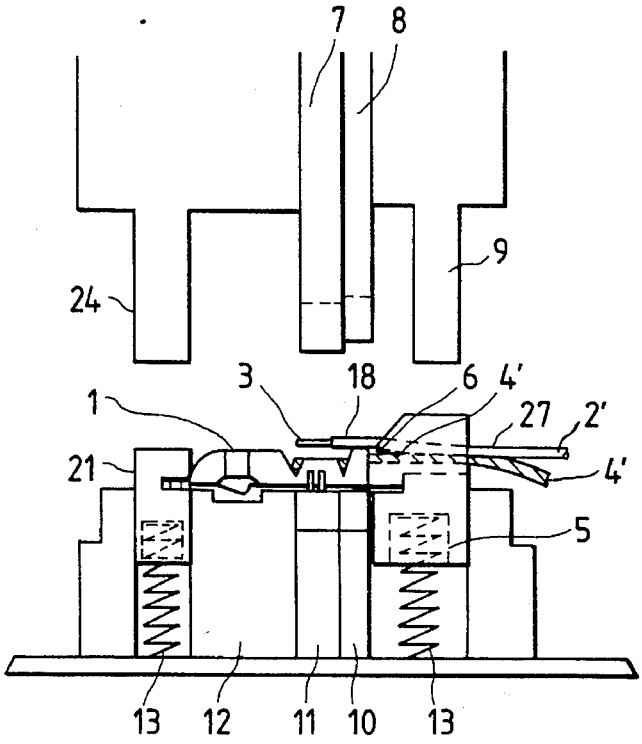
FIG. 1B is a schematic diagram showing a crimping apparatus of a second embodiment of the invention.

FIG. 1B shows a second embodiment of the invention. The central conductor 3 used in this embodiment comprises the tin-plated copper alloy conductors as in the first embodiment. An external sheath 27 is disposed about the central conductor 3 to form a cable 2'. The sectional area of the central conductor 3 of the cable 2' is approximately 0.005 $mm^2$. Further, a dummy conductor 4' is prepared comprising twisted wires and is similar to the twisted wire 4 of the first embodiment and having a sectional area of about 0.025 mm . However, the dummy conductor 4' is made of twisted wires which are not part of a coaxial cable. That is, the twisted wires are independent of the conductor 3.

A small crimp-style terminal 1 similar to that shown in FIGS. 4A and 4B and used in the first embodiment is crimped to the cable 2' by an apparatus shown in FIG. 1B. As in the first embodiment, the sectional area of a suitable wire to which the terminal 1 can be crimped is within the range of about 0.013 to 0.032 mm (AWG36 to AWG32). The crimping process is as follows.

Figure 2B:
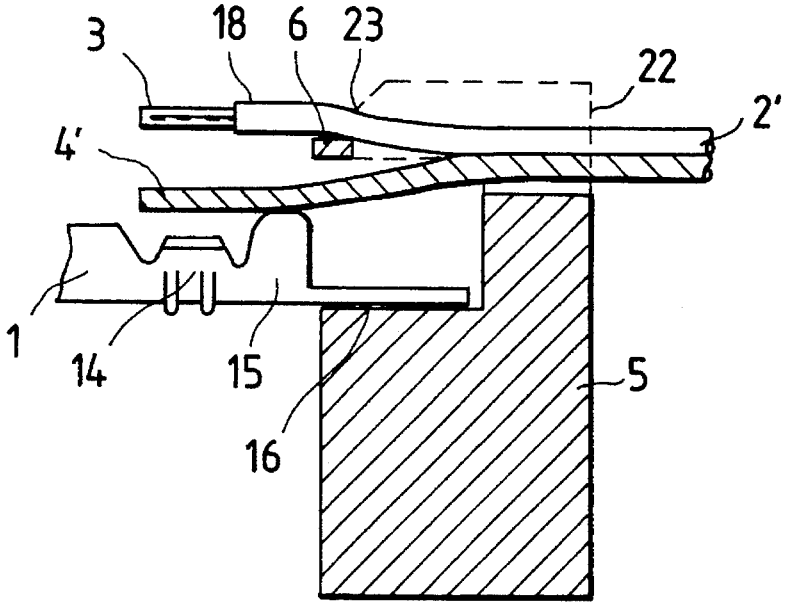
FIG. 2B is an enlarged view of the cutter block of the second embodiment.
Figure 3:
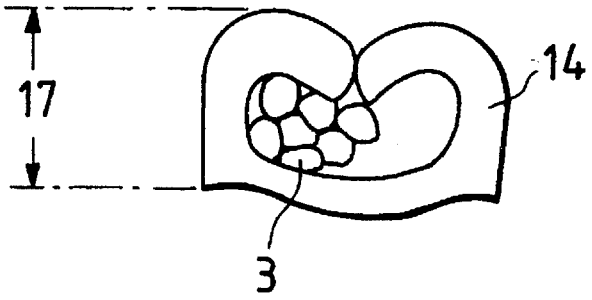
FIG. 3 PRIOR ART
FIG. 3 is an exemplary illustration of a defective crimping condition.

As shown in FIG. 1B, the terminal 1 is placed at a predetermined location on a base 12 of the crimping apparatus with its tip inserted in an opening in block 21. As shown in FIG. 2B, which is an enlarged view of the cutter block 5, the central conductor 3 and dummy conductor 4' are inserted through a guide 22 (see FIG. 5) in the cutter block 5. As further shown in FIG. 2B, the dummy conductor 4' is inserted through a hole 23 (see FIG. 5) and placed below the blade 6 of the cutter block 5, and the central conductor is guided through the guide 22 in the cutter block 5 above the blade 6.

As in the first embodiment, to crimp the terminal 1 to the coaxial cable 2, a push block 9, an insulation crimper 8, a wire crimper 7, and a stabilizing block 24 are lowered simultaneously toward cutter block 5, insulation anvil 10, wire anvil 11, and block 21, respectively. Block 21 is supported by spring 13 which allows block 21 to move slightly in a vertical direction against the movement of the stabilizing block 24, if necessary, to maintain the terminal 1 substantially in parallel with the crimpers, anvils and blocks.

Accordingly, the insulation crimper 8 and insulation anvil 10 cooperate to crimp the insulation crimping portion 15 about both the insulation 18 of the conductor 3 and the dummy conductor 4'. Also, the wire crimper 7 and wire anvil 11 cooperate to crimp the conductor crimping portion 14 about both the conductor 3 and the dummy conductor 4'.

As the push block 9 is lowered, the push block 9 pushes the cutter block 5 downward against the force of spring 13. As a result, the blade 6 of the cutter block 5 forces the dummy conductor 4' against an extended portion 16 of the base portion 26 of the terminal 1, and shears both the dummy conductor 4' and the extended portion 16. Thus, the dummy conductor 4' is severed from the remaining spirally twisted wires.

Accordingly, in a manner similar to that of the first embodiment, this procedure allows an oversized crimp-style terminal to be crimped securely to a conductor having extremely thin wires. Also, although twisted wires are used as the dummy conductor in this embodiment, other suitable types of dummy conductors can be used.

As described with reference to the above embodiments, this invention enables an oversized terminal to be crimped easily to a conductor having sectional area as small as, for example, about 0.005 $mm^2$. Hence, this invention provides an efficient and reliable method for processing cables with terminal connectors to be used, for example, in medical equipment and electronic instruments.

Although the preferred embodiment of this invention has been described, it will be obvious to those skilled in the art that various changes and modifications may be made therein without departing from the invention. Therefore, the claims are intended to include all such changes and modifications that fall within the true spirit and scope of the invention.

What is claimed is:

1. A method of connecting a crimp-style terminal having a crimping portion to a cable having a first conductor and a second conductor, comprising the steps of:

forming a dummy conductor segment; and crimping the crimping portion of the terminal collectively about both the dummy conductor segment and a portion of the first conductor of the cable to cause the dummy conductor segment and the first conductor to contact one another and to cause the crimping portion to secure the terminal to the cable.

2. A method as claimed in claim 1, wherein the step of forming a dummy conductor segment comprises the steps of:

separating a portion of the second conductor of the cable from the first conductor; and cutting off an end of said second conductor to obtain the dummy conductor segment.

3. A method as claimed in claim 2, wherein the cutting step and the crimping step are performed substantially simultaneously.

4. A crimping apparatus for crimping a terminal having a crimping portion about an end of a first conductor of a cable and a dummy conductor segment, wherein the dummy conductor segment is obtained from a second conductor, comprising:

means for positioning the terminal, an end of the second conductor, and the end of the first conductor of a cable relative to one another;

means for cutting the dummy conductor segment from the end of the second conductor, said second conductor being disposed in said positioning means; and means for crimping the crimping portion of the terminal collectively about both the dummy conductor segment and the end of the first conductor of the cable, which are disposed in said positioning means, to cause the dummy conductor segment, the first conductor, and the crimping portion to contact one another to secure the terminal to the cable.

5. A crimping apparatus as claimed in claim 4, wherein said positioning means comprises:

a first member on which the terminal is disposed;

a second member, adjacent to and moveable relative to said first member, having a cable guide in which the first conductor of the cable and the second conductor is guided, said cable guide having a hole formed therethrough through which an end of the second conductor is passed to thereby separate respective ends of the first conductor and the second conductor, such that their respective ends extend away from an end of said second member and above the crimping portion of the terminal disposed on said first member.

6. A crimping apparatus as claimed in claim 4, wherein the cutting means and crimping means operate substantially simultaneously.

7. A crimping apparatus as claimed in claim 5, wherein the end of first conductor is vertically disposed above the end of the second conductor with the end of said second member disposed therebetween.

8. A crimping apparatus as claimed in claim 7, wherein said cutting means comprises said end of said second member movable in shearing manner relative to said first member.

9. A method of connecting a crimp-style terminal having a crimping portion to a cable having a first conductor, comprising the steps of:

obtaining a dummy conductor segment from a second conductor which is independent of the cable; and crimping the crimping portion of the terminal collectively about both the dummy conductor segment and a portion of the first conductor of the cable.

10. A method as claimed in claim 9, wherein said step of obtaining the dummy conductor segment comprises the steps of:

feeding the cable and the second conductor into a separating device to position respective ends of the first conductor and the second conductor separated from one another;

cutting off an end of the second conductor to obtain the dummy conductor segment.

11. A method as claimed in claim 10, wherein in said cutting and said crimping steps are performed substantially simultaneously.

* * * * *